US007641567B2

(12) United States Patent
Brooks

(10) Patent No.: US 7,641,567 B2
(45) Date of Patent: Jan. 5, 2010

(54) GOLD PUTTING TRAINING APPARATUS AND METHOD

(76) Inventor: Roger John Brooks, 7 Airedale, Galgate, Lancaster (GB) LA2 0RR ( * ) Notice: Subject to any disclaimer, the term of this patent is extended or adjusted under 35 U.S.C. 154(b) by 0 days.

(21) Appl. No.: 11/829,220

(22) Filed: Jul. 27, 2007

(65) Prior Publication Data

US 2008/0026864 A1 Jan. 31, 2008

(51) Int. Cl.
*A63B 69/36* (2006.01)

(52) U.S. Cl. ..... 473/257; 473/258; 473/226

(58) Field of Classification Search ..... 473/219, 473/223, 224, 226, 227, 229, 251, 257–266, 473/276, 409
See application file for complete search history.

(56) References Cited

U.S. PATENT DOCUMENTS 2,776,836 A * 1/1957 Zadina ..... 473/226
3,190,658 A * 6/1965 Kane ..... 473/227
4,133,535 A * 1/1979 Marsh ..... 473/229
4,453,717 A * 6/1984 Solheim et al. ..... 473/265
4,634,131 A * 1/1987 Vella et al. ..... 473/229
5,026,066 A * 6/1991 Kane ..... 473/227
5,074,565 A * 12/1991 Tucker ..... 473/229
5,150,904 A * 9/1992 Sindelar ..... 473/251
5,645,494 A * 7/1997 Dionne et al. ..... 473/278
2007/0060411 A1 3/2007 Dorman

* cited by examiner

*Primary Examiner*—Nini Legesse

(57) ABSTRACT

Apparatus for training golfers in putting techniques and the method for its use are taught. The principle of the apparatus of the invention provides two reference points, one of which is adjustable and fixed relative to the head of a putter. By sliding the two reference points along a guidance surface, the putting head moves parallel to the guidance surface with the face of the putting head at a constant angle to the guidance surface. i.e. this is a putting stroke. One of the reference points may be a part of the putter head and the other is a member, removably attachable to the putter and adjustable so that a contact head touches, and is slidable along, the guidance surface.

4 Claims, 3 Drawing Sheets

GOLD PUTTING TRAINING APPARATUS AND METHOD

BACKGROUND OF THE INVENTION

This specification relates to apparatus and a method of using the apparatus for learning and practicing golf putting strokes.

Golf is a popular game but one that is technically demanding. Learning the correct technique can lead to significant improvements in a golfer's performance. An important part of the game is putting and various training devices have been invented with the aim of helping golfers to improve their putting technique.

One type of training device guides the putter so that the golfer learns to move the putter in a particular way. Repeated practice with such a device trains the golfer to swing the putter in a certain way, with the aim of improving the technique and consistency of the golfer's putting stroke so that the golfer achieves improved performance when playing on the course.

Some devices, such as U.S. Pat. No. 4,453,717, provide a planar guide surface along which the player slides the heel of the putter. However such a device has the disadvantage that it does not assist the player in controlling the angle of the face of the putter during the putting stroke, which is a very important aspect of putting technique. GB 2 364 922 provides a planar guide surface but also provides lines on the base which indicate the correct angle of the putter face. Other shapes of guide are possible such as the curved vertical surface provided by U.S. Pat. No. 6,561,920.

U.S. Pat. No. 5,072,943 describes a T shaped device for controlling the angle of the putter face which is used by attaching the stem of the T shape to the face of the putter. The surface of the device that is perpendicular to the part attached to the putter face is kept in contact with a planar guide surface. This keeps the putter face substantially perpendicular to the guide surface. However, this device has the disadvantage that it must be manufactured precisely in order for the putter face to be exactly perpendicular to the planar surface. A further disadvantage is that the device attaches to the head of the putter and since the shapes and sizes of putter heads vary greatly it is very difficult for any such device to fit securely on all models of putter.

U.S. Pat. No. 2,776,836 includes a clamp that is attached to the putter shaft with a pair of arms normal to the clamp. The arms contact a planar guide surface but the nature of the device has the disadvantage that the planar surface must extend considerably above the head of the putter. In U.S. Pat. No. 2,776,836 the planar guide surface is raised up above the ground. Another disadvantage of this device is that, since it has two arms that extend beyond the putter head on both sides, the length of the putting stroke that can be made whilst both arms maintain contact with the guide surface is restricted. A further disadvantage is that the putter head is not guided directly by the invention because the putter head itself is not in contact with the guide surface. Consequently, this invention does not ensure that the putter head always follows a particular path. For example, if the golfer changes the angle of the putter shaft during the stroke then the ball could be struck either near the toe of the putter or near the heel (as opposed to in the centre of the putter face) resulting in a miss-hit putt. The construction of this device also makes it complicated and expensive to manufacture.

U.S. Pat. No. 3,190,658 includes a removably mounted clamp with a single arm that attaches to the shaft of the putter. In U.S. Pat. No. 3,190,658 the clamping device slides along a flat guide surface held against the golfer's legs above the golfer's knees. This method attempts to provide a guide for the path of the putter but, as for U.S. Pat. No. 2,776,836, it has the disadvantage that the device does not guide the putter head directly. Furthermore, this method does not control the angle of the putter face.

BRIEF SUMMARY OF THE INVENTION

The object of the present invention is to provide apparatus and its method of use so that it trains the golfer to control both the line of movement of the putter head and the angle of the face of the putter head during the whole of the putting stroke.

According to a first embodiment of the invention there is provided apparatus for training golfers in the principles of putting, comprising: a putter, having a putting head with at least one end and a face for striking the ball; a guidance means, removably and adjustably attachable to an appropriate part of the putter, said guidance means having a contact head; and a guide member, having an extended guidance surface; characterised in that when the guidance means is attached to the putter and both the contact head and the end of the putting head are placed in contact with and maintained in contact with the guide member, the putter may be swung to execute a putting stroke parallel to the surface of the guide member with the face of the putting head at a constant angle to the surface of the guide member.

According to a first variation of the first embodiment of the invention, the end of the putting head is a heel or a toe.

According to a second variation of the first embodiment of the invention, the part of the putter to which the guidance means is attached is the shaft.

According to a third variation of the first embodiment of the invention, the attachment of the guidance means to the putter is adjustable so that at the address position the constant angle which the putting head makes in the horizontal plane with the guidance surface when both the end of the putter head and the contact head are in contact with the guidance surface is essentially a right angle.

According to a fourth variation of the first embodiment of the invention, the attachment of the guidance means to the putter is adjustable so that at the address position the constant angle which the putting head makes in the horizontal plane with the guidance surface when both the end of the putter head and the contact head are in contact with the guidance surface is preset to a personal preference.

According to a fifth variation of the first embodiment of the invention, the contact head has a form adapted to slide smoothly along the surface of the guide member.

According to a sixth variation of the first embodiment of the invention, the guide member is adapted to stand stably on the surface on which the putting training is being undertaken.

According to a seventh variation of the first embodiment of the invention, the extended guidance surface of the guide member is essentially flat and extends upwardly from and longitudinally along the surface on which putting training is being undertaken.

According to an eighth variation of the first embodiment of the invention, the guidance surface extends vertically upwards from the surface on which putting training is being undertaken.

According to a ninth variation of the first embodiment of the invention, the guidance surface extends upwards at an angle to the vertical from the surface on which putting training is being undertaken.

According to a tenth variation of the first embodiment of the invention, the upward extension of the guidance surface has a curve along the whole of its longitudinal length.

According to an eleventh variation of the first embodiment of the invention, the guide member is used on top of a flat member, the surface of which is being used for putting training, said flat member having lines at right angles to each other so that the alignment of the putter head and direction in which the ball is hit can be monitored.

According to a twelfth variation of the first embodiment of the invention, the natures of the end of the putting head, contact head and guidance surface are such that an audible sound is produced when the end of the putting head and the contact head are moved along and in contact with the guidance surface.

According to a thirteenth variation of the first embodiment of the invention, electronic means are provided in/near the contact head to monitor the strength of contact and/or loss of contact between the contact head and the guidance surface.

According to a second embodiment of the invention there is provided apparatus for training golfers in the principles of putting, comprising: a putter, having a putting head and a face for striking the ball; two guidance means, each removably and adjustably attachable to an appropriate part of the putter, each having a contact head; and a guide member, having an extended guidance surface; characterised in that when the two guidance means are attached to the putter and both contact heads are placed in contact with, and maintained in contact with, the guide member, the putter may be swung to execute a putting stroke parallel to the surface of the guide member with the face of the putting head at a constant angle to the surface of the guide member.

According to a first variation of the second embodiment of the invention, the part of the putter to which the two guidance means are attached is the shaft.

According to a second variation of the second embodiment of the invention, the first guidance means is attached to the leading side of the putter shaft and the second guidance means is attached to the trailing side of the putter shaft.

According to the invention there is provided a method for training golfers in the principles of putting, comprising: providing a putter, having a putting head with at least one end and a face for striking the ball; attaching a guidance means, having a contact head, to an appropriate part of the putter; taking a guide member, having an extended guidance surface; and adjusting the attachment of the guidance means so that both the contact head and the end of the putting head just touch the guidance surface of the guidance member when the putting head is aligned essentially at right angles to the guidance surface at the address position; so that when the putter is swung, while maintaining simultaneous contact between the end of the putting head and the guidance surface and between the contact head and the guidance surface, the putter will move to execute a putting stroke parallel to the guidance surface with the face of the putting head at a constant angle to the guidance surface.

According to a first variation of the method of the invention, the guidance member is aligned with a first line on the floor/a mat on the floor on which putting training is taking place so that the exact direction in which the ball is struck can be determined.

According to a second variation of the method of the invention, a second line, perpendicular to the first line on the floor/a mat on the floor on which putting training is taking place, allows the head of the putter to be aligned exactly at right angles to the plane of the guidance surface.

The principle of the apparatus of the invention provides two reference points, one of which is the guidance means and is adjustable, relative to the head of the putter, and the other of which is a part of the head of the putter itself, so that when these two points are caused to slide along an extended guidance surface, the putting head will move in a smooth line, i.e. this is the putting stroke. By using the guidance means adjustment to ensure that the face of the putter head is essentially at right angles to the guidance surface in the horizontal plane at the address position, a golf ball hit, in the putting stroke, will follow a straight line, parallel to the guidance surface.

Preferably, the adjustable means is attached to the shaft of the putter near to the head of the putter and its contact head is one reference point and the heel of the putter is the other. When these two points are adjusted, as described above, a golfer can practice moving the putter head along the guide member, with the heel and contact head in continuous contact with guidance surface. This will teach the golfer the patience and control necessary to move the putter in a steady, smooth stroke so that the putter head moves in a correct line, parallel to the guidance surface.

Preferably, training takes place on a floor, or a mat, on which a longitudinal line and a line perpendicular to it are drawn. The guidance surface will be aligned with the longitudinal line and the attachment of the guidance means adjusted so that the contact head just touches the guidance surface when the face of the putter head (which actually strikes the ball) is in line with the perpendicular line, i.e. the face will be essentially at right angles to the guidance surface. Thus, the apparatus of the invention and method of its use firstly teaches the golfer to produce accurate, smooth controlled movements with the putter and then to transfer these to the actual putting process with a ball. This is an integral part of improving a golfer's technique of putting.

In the above preferred application, the two reference points are the heel of the putter and the contact head of the guidance means but they could equally well have been the toe of the putter and the contact head or two contact heads of two guidance means. Heel and toe are conventional terms applicable to most designs of putter but for putters of unconventional designs, an appropriate point would be used.

It is a feature of the invention that the reference points should slide smoothly across the guidance surface. The heels and toes on most putters would meet this requirement but could be polished with furniture polish, if required. The contact heads would preferably be spherical to promote easy sliding. Ideally, the contact heads would make a noise as they slide along the guidance surface and this frictional movement would also give the golfer a 'feel', so that both sound and feel would as forms of positive feedback—this would enable the golfer to monitor the continuing contact/loss of contact. Electronic means may also be used to monitor this contact/loss of contact.

The guidance means and contact head would be as light as practical so as not to disturb the balance of the putter more than absolutely necessary. Ideally the guidance means is attached to the putter shaft so that the contact head is at about the same height as the putting head when the putter is held in the normal putting address position.

BRIEF DESCRIPTION OF THE SEVERAL VIEWS OF THE DRAWINGS

For a clearer understanding of the apparatus of the invention and the method of its use, reference will now be made, by way of example only, to the accompanying drawings, in which:—

DETAILED DESCRIPTION OF THE INVENTION

Figure 1:
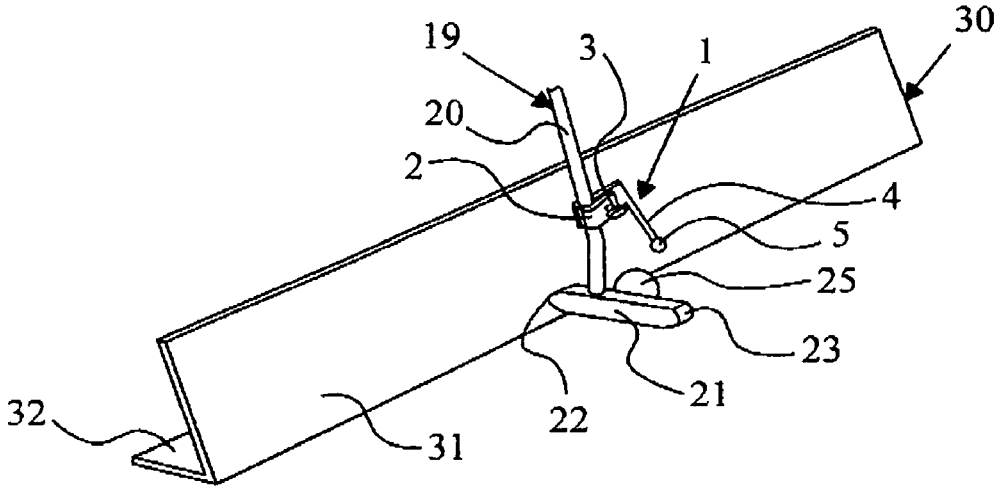
FIG. 1 is a perspective view of the apparatus of the invention in use, attached to the shaft and deployed on the leading side of the putter, when the heel of the putter is sliding along an inclined planar guide surface.
Figure 2:
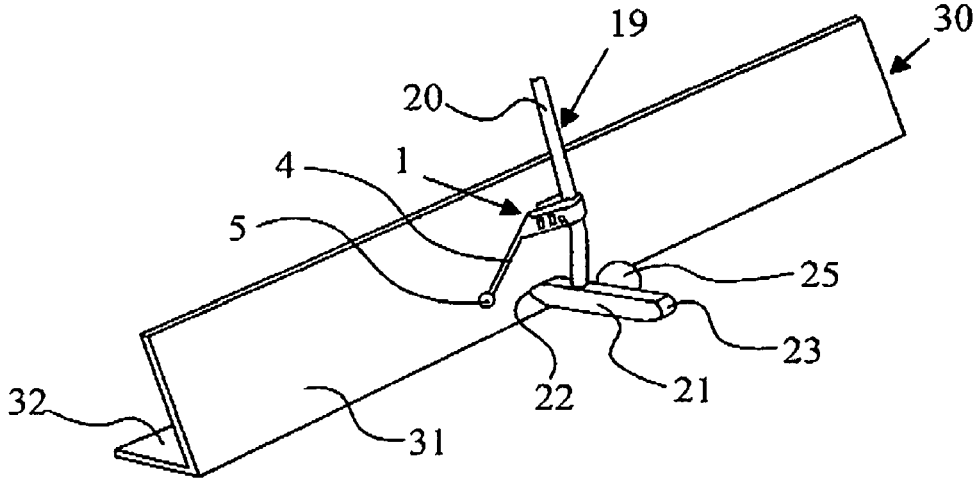
FIG. 2 is a perspective view, similar to that in FIG. 1 but with the apparatus of the invention attached to the shaft and deployed on the trailing side of the putter.
Figure 3:
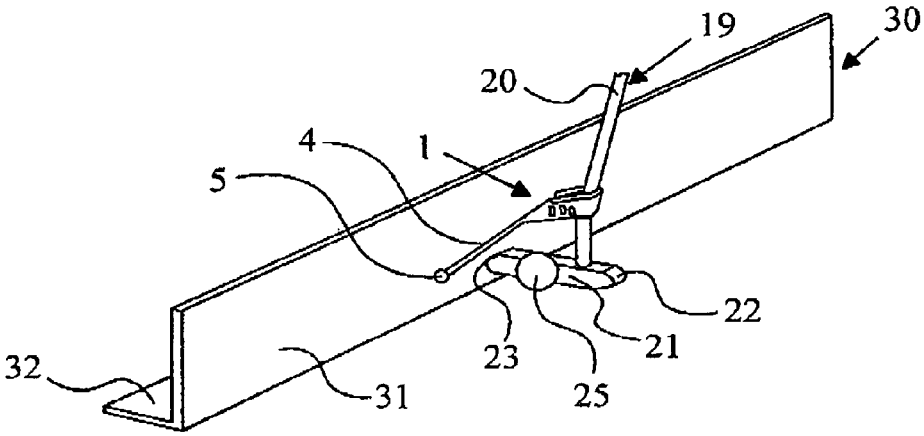
FIG. 3 is a perspective view, similar to that in FIG. 1, with the apparatus of the invention in use, attached to the shaft and deployed on the leading side of the putter, when the toe of the putter is sliding along a vertical planar guide surface.
Figure 4:
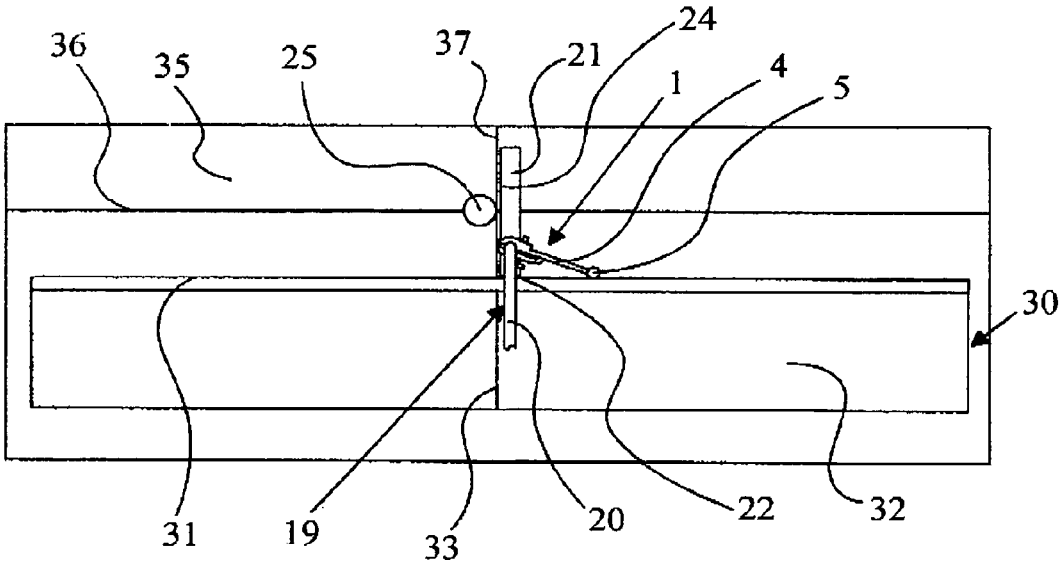
FIG. 4 is a plan view of the apparatus of the invention as being used in FIG. 2, but with a vertical planar guide surface, showing the use of guide lines on both the planar guide and on a mat to obtain the desired angular alignment of the putter face during a putting stroke.

As shown in FIG. 1, apparatus 1 of the invention is attached to the putter shaft 20, near the bottom of shaft 20, and consists of mounting 2 removably clampable by means of screw 3. Fast with mounting 2 is rod 4 with spherical contact head 5 at its distal end. FIG. 1 also shows the lower part of the putter 19, with shaft 20 and head 21. The ends of putter head 21 are heel 22 and toe 23. FIG. 1 also shows a guide member 30, which includes planar guide surface 31, along which heel 22 of putter head 21 may be moved, and base 32. Mounting 2 and damping means 3 (FIG. 6) are such that rod 4 and contact head 5 may be aligned to contact guide surface 31 either ahead of the leading face of putter head 21 (FIGS. 1 and 3) or behind the trailing face of putter head 21 (FIGS. 2 and 4). Similarly, guide member 30 may be arranged so that either heel 22 (FIGS. 1, 2 and 4) or toe 23 (FIG. 3) of putter head 21 and contact head 5 both touch. surface 31. Guide surface 31 may be either inclined towards the golfer (FIGS. 1 and 2) or vertical (FIGS. 3 and 4).

Figure 5:
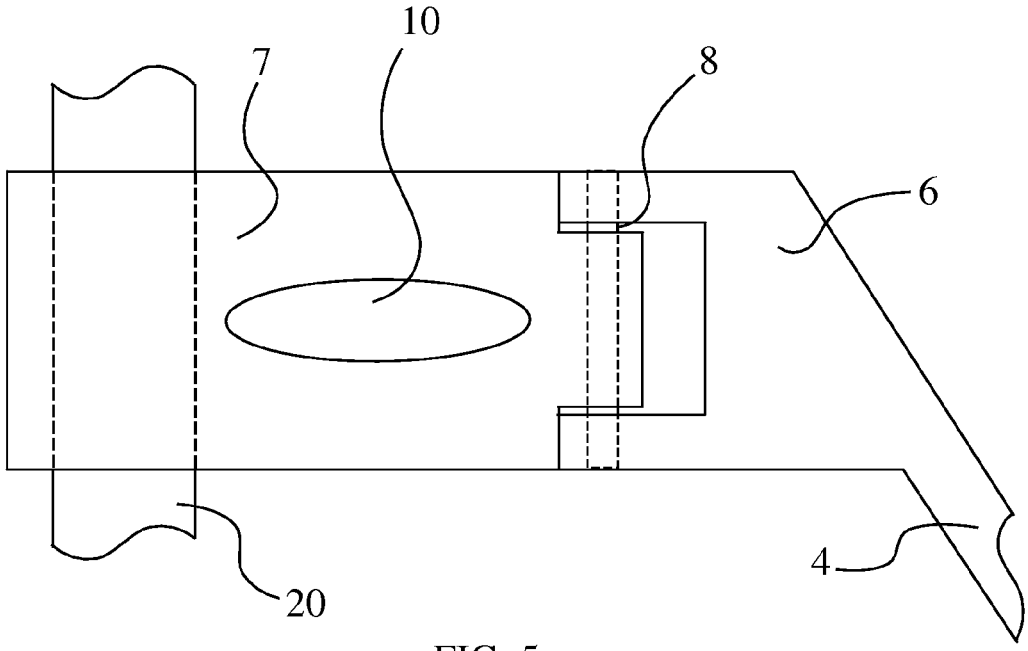
FIG. 5 is an elevation of a detail of the mounting arrangement of the device onto the putter shaft.
Figure 6:
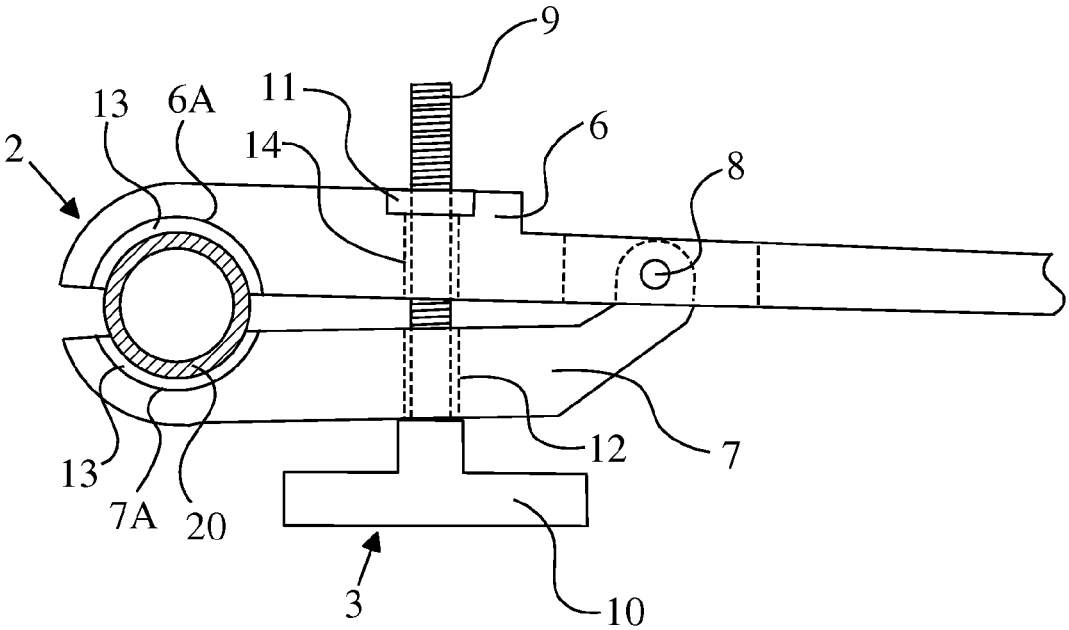
FIG. 6 is a plan view of the detail, shown in FIG. 5, of the mounting arrangement of the device onto the putter shaft.

FIGS. 5 and 6 show details of the arrangement for mounting the apparatus 1 of the invention onto putter shaft 20. It consists of main body 6 and hingable member 7 and clamping means 3. Members 6 and 7 are hinged together 8 and have co-operating ends 6A and 7A to grip shaft 20, via foam pads 13. A hand-operable head 10 allows screw 9, which passes through hole 12 in member 7 and hole 14 in member 6, to be turned in nut 11, captive in member 6, to bring sections 6A and 7A together and clamp them around shaft 20. Fast with member 6 is rod 4, having contact head 5 at its distal end. Preferably contact head 5 is in the form of a ball (5, FIGS. 1-4), to aid sliding contact along surface 31. The clamping means 2, formed by sections 6A and 7A, is adjustable, both vertically on, and rotatably around, shaft 20, so that both heel 22 (FIGS. 1, 2 and 4) or toe 23 (FIG. 3) and head 5 can simultaneously contact guide surface 31.

Apparatus 1 is removable from shaft 20 at the end of the training session.

The method of using the apparatus of the invention 1 is to adjust the position of contact head 5 until both contact head 5 and heel 22 of putter head 21 touch surface 31 of guide member 30 (FIGS. 1, 2 & 4). Guide member 30 has base 32 to allow it to stand stably on a flat floor. The golfer swings the putter forwards and backwards, in the manner of a putting stroke, trying to keep both heel 22 and contact head 5 in contact with surface 31 throughout the putting stroke. If contact is maintained throughout, the stroke will be correct. If contact is lost by either heel 22 or ball 5, the golfer may detect this, either visually or by the change in sound of the sliding contacts or via a change of feeling through holding the putter. When loss of contact occurs, the golfer will take appropriate corrective action.

The golfer could practice the swing without a ball 25 until he/she is satisfied with their technique and then try with a ball 25. The apparatus of the invention is so shaped to fit most commonly-available putter shafts 20, whether straight or with bends and of different lengths. Ideally, the adjustment 3 is such that contact head 5 is located approximately level with putter head 21 when the putter is held in the usual putting address position, as shown in FIGS. 1, 2 and 4. In FIGS. 5 & 6, rod 4 is shown as an extension to member 6; the length of rod 4 may be adjustable, if required, but this is not shown to avoid unnecessary detail.

In FIGS. 1 and 3, the apparatus 1 of the invention is shown with contact head 5 located ahead of putter head 21. In FIGS. 2 and 4, apparatus 1 is shown with contact head 5 located behind putter head 21. FIGS. 1, 2 and 4 show contact head 5 and heel 22 in contact with guide surface 31 and FIG. 3 shows contact head 5 and toe 23 in contact with surface 31. This indicates how apparatus 1 may be adapted to personal preference, when training to improve putting technique. Having mastered one preference, a competent golfer may opt to practice with another arrangement to perfect his technique.

The apparatus 1 and its method of use can employ any shape of planar guide surface including those inclined towards the golfer (FIGS. 1 and 2) or a vertical planar surface (FIGS. 3 and 4). It is also possible to use an essentially vertical curved surface, which some golfers might find easier to use. Guide surface 31 could be part of a specially designed item, e.g. guide member 30, or it could be any other suitable planar surface, e.g. a skirting board in a house, as in the arrangement shown in FIG. 3.

The key to the invention is that it trains the golfer to maintain contact between both head 5 and, either heel 22 or toe 23, and guide surface 31 throughout the whole of the swing. This will mean that the angle between striking face 24 of putter head 21 and guide surface 31 will remain constant throughout the whole swing. The next part is to make sure that this angle is essentially a right angle so that, when struck, ball 25 will follow a straight path, parallel to the plane of guide surface 31.

The apparatus 1 and method of its used is appropriate when sliding any part of the head 21 of the putter along a guide surface 31. The heel 22 or toe 23 are the most convenient contact points to use, but other parts are equally possible, e.g. a part of shaft 20. Contact head 5 is shown as a ball at the end of rod 4 but any other shape 5 and design of supporting member 4 are equally possible. The principle of the invention teaches the use of two members, fixed in relation to the putter head 21, sliding along the guide surface 31, to monitor the motion of putter head 21. Thus, it is also possible to use a second apparatus 1 of the invention in place of a part of the putter head 21. For example, two apparatuses 1 of the invention, e.g. one located ahead of the putter (FIG. 1) and the other located behind it (FIG. 2), could be the two fixed points, sliding along surface 31, to monitor the motion of putter head 21 throughout its swing.

FIG. 4 shows a golfer's eye view of the apparatus 1 of the invention in use. The aim is to keep heel 22 and head 5 in contact with surface 31, throughout the whole of the putting stroke, i.e. the backswing, (moving to the right), the foreswing, (moving back to the left), striking ball 25 and the follow through, (moving further to the left).

The next step is to make sure that face 24 of head 21 and ball 25 is essentially at 90° to the line of the putt at address and at the point of contact with ball 25. FIG. 4 is a plan view of mat 35, with a longitudinal line 36 and perpendicular line 37 printed on it. The method of use is to place guide member 30 on met 35 so that perpendicular line 33 on base 32 of guide member 30 aligns with line 37 on mat 35. This will make face 31 parallel to line 36. (Guide member 30 is placed on mat 35 so that face 31 is an appropriate distance from line 36 for ball 25 to be struck in the centre of face 24 of puller head 21.) Mounting 2 is adjusted 3 so that the edge of face 24 aligns with line 37 when heel 22 and head 5 are both just in contact with surface 31. (Face 24 is the leading face of putter head 21. i.e. the face that strikes ball 25.) Face 24 of putter head 21 now at right angles to line 36 and, if the golfer can maintain both heel 22 and head 5 in contact with surface 31 throughout the putting stroke, ball 25 will follow line 36 to the left, when struck. The guide member 30 could also be used without a mat, with line 33 on the guide member 30 used as a reference to achieve the correct alignment of face 24 of putter head 21.

Though 90° is the preferred angle between the planes of face 24 and surface 31, some golfers may have developed a unique stance and/or address position and, because of this, prefer an angle other than essentially 90°, for example, 85°. The apparatus and method of use can accommodate such requirements, e.g. by drawing an extra line 37, at the appropriate angle (not shown), on mat 35.

Visual monitoring and listening to the sound of the sliding of heel 22 and head 5 along surface 31 have been taught. However, electronic devices may be incorporated in apparatus 1 to assist the golfer with this task. For example, a microswitch (not shown) in head 5 may be used to detect too much pressure on surface 31 and activate a first audible device (not shown), incorporated in/on member 6. Additionally, a loss of contact means (not shown) could be incorporated into head 5 to be activated when contact was lost with surface 31 and operating a second audible device. Optical warnings, e.g. a LED in the upper surface of member 6, could be used in place of audible warnings.

A further possible method to monitor loss of contact means could be if surface 31 was made of a suitable substance to activate a dielectric-form of distance sensor, such as are used in touch-activated devices.

Devices, such as disclosed, are electronic in nature and would require a battery and circuitry (not shown), e.g. mounted in/on member 6. This could be very light in weight, to avoid upsetting the balance of the putter. The first and second audible devices could be the same means, e.g. with single beats indicating excessive contact and double beats indicating loss of contact.

Repeated practice with the apparatus 1 of the invention will enable a golfer to perfect the timing of the swing and angle of the putter head, as well as perfecting a smooth action, so that ball 25 is hit with an appropriate force for the whole range of putting situations likely to be encountered. Competence with putting will improve the golfer's confidence and the standard of his/her play and, thus, the enjoyment gained, whether it is played as a sport or for recreation.

Many sizes and shapes of apparatus 1 are possible. In particular, different dimensions are possible for the distance and angle between the mounting 2 and contact head 5. For most putters the lower part of the shaft 20 is closer to the heel 22 of the putter than to the toe 23. Consequently the choice of these dimensions may be affected by whether apparatus 1 is intended to be used when sliding the heel 22 of the putter (FIG. 1) or the toe 23 (FIG. 3) along guide surface 31. Apparatus 1 may be designed so that it can be used either for sliding heel 22 or toe 23 of the putter head 21 along a guide surface 31.

A simple V-shaped hinged, screw-operated clamp 2, 3 has been taught for securing the apparatus of the invention to the putter shaft but any suitable clamping means, adjustable both axially along the shaft and rotationally around it, is equally applicable.

I claim:

1. A putting device for improving a golfer's stroke comprising: a putter having a shaft, a head with a toe end and a heel end, and a face for striking a golf ball; an apparatus comprising a hingeable mounting arrangement that includes a main body, hingeable member and clamping means; a rod with spherical contact head extends from the main body; a guide member with a planar guide surface and a base comprising a top surface and a bottom surface; wherein the base comprises a line on the top surface; during putting practice, the apparatus is removably attached to the club shaft by the hingeable mounting arrangement and both the contact spherical head and one of the putter head ends are maintained in contact position with the guide member; when the putting stroke is executed, both the contact spherical head and one of the putter head ends would produce an audible sound.

2. The putting device as claimed in claim 1, wherein the device includes a mat with a top and bottom surface; wherein the top surface has a vertical and horizontal lines that cross each other at 90 degrees; when the mat is used during a putting practice, one of the lines on the mat is aligned with the base line.

3. The device as claimed in claim 1, wherein the planar guide surface is at inclined angle with respect to the guide base.

4. The device as claimed in claim 1, wherein the planar guide surface is at right angle with respect to the guide base.

* * * * *